US005984727A

United States Patent [19]

Wu et al.

[11] Patent Number: 5,984,727

[45] Date of Patent: Nov. 16, 1999

[54] MINI ELECTRICAL CONNECTOR

[75] Inventors: Kun-Tsan Wu, Tu-Chen; Susam Hsu, Hsin-Chu Hsien, both of Taiwan

[73] Assignee: Hon Hai Precision Ind. Co., Ltd., Taipei Hsien, Turkey

[21] Appl. No.: 08/933,408

[22] Filed: Sep. 19, 1997

[30] Foreign Application Priority Data

Nov. 2, 1996 [TW] Taiwan ..... 85216876

[51] Int. Cl.[6] ..... H01R 13/648

[52] U.S. Cl. ..... 439/607

[58] Field of Search ..... 439/607, 609, 439/92, 95, 108, 79

[56] References Cited

U.S. PATENT DOCUMENTS 5,637,015 6/1997 Tan et al. ..... 439/607

*Primary Examiner*—Steven L. Stephan
*Assistant Examiner*—Eugene G. Byrd

[57] ABSTRACT

A mini electrical connector for electrically connecting an exterior mating connector and a circuit board, mainly comprises an insulative housing, a first shell means and a second shell means. The first shell means includes a shielding portion which has a third retentive section for locking a protrusion formed on the housing and has an orienting section. The second shell means includes a pair of first retentive sections for retentive cooperation with the orienting sections of the first shell means, and a pair of second retentive sections for retentive cooperation with the housing. By means of the first retentive sections, the second retentive sections and the third retentive section, the connector is easy and convenient to be assembled with the first shell means and the second shell means for some connector manufacturers.

7 Claims, 5 Drawing Sheets

MINI ELECTRICAL CONNECTOR

BACKGROUND OF THE INVENTION

1. Field of the Invention

The invention relates to a mini electrical connector for electrically connecting an exterior mating connector to a circuit board, and particularly to a mini electrical connector with a shell means which includes a grounding portion and a shielding portion for both of the grounding protection and shielding protection with respect to the mini electrical connector.

2. The Prior Art

At present, some electrical apparatus like the computerized products based on the requirement of customers, are generally dimensioned to be light, small and delicate. For example, the full weight and dimension of most computer systems or peripheral, have been designed into being portable which is convenient for customers to carry these computer systems with them. By the way, due to the intention of the miniaturization of the computer design, it occurs that all of the associated electrical assembies arranged in the computer systems must be miniaturized for compliance with the interior space of the small-sized computer systems. These electrical assembles mostly consist of chips and electrical connectors wherein these electrical connectors may occupy more space than the chips in the computer systems. Therefore, for connector manufacturers, it is very important how to miniaturize the dimension of the electrical connectors or how to reduce the occupied space of the electrical connectors in the computer systems.

However, the structural design of some conventional electrical connectors used to be assembled within the computer system still waste space, because these conventional electrical connectors need maintain a few waste space to receive a grounding portion and a shielding portion therein for grounding and shielding protection against ESD and EMI.

Oppositely, some of the other type conventional electrical connectors sacrifice some associated structures with regard to said shielding portion or the grounding portion, so that the retention effect between the connectors and their shielding portions or their grounding portions is poor. It causes that through many times to be inserted/withdrawn with an exterior mating connector, the shielding portion or grounding portion may be loose, even separated from an insulative housing of the connector.

The foregoing conventional electrical connectors can refer to the disclosures of Taiwan Patent Application Nos. 77,208,107, 78,204,790, 80,104,898, 80,208,342, 80,211,820, 82,111,200, 82,201,874 and 84,201,441, and U.S. Pat. Nos. 4,637,669, 4,842,554, 4,842,554, 4,842,555, 4,908,335, 4,995,819, 5,017,158 and 5,186,633.

Accordingly, for resolving the above disadvantages, an object of the invention is to provide a mini electrical connector which includes and a first shell means and a second shell means wherein the first shell means can provide the connector with both of the shielding protection and grounding protection.

Another object of the invention is to provide a mini electrical connector with the first shell means which includes a third retentive section and a pair of orienting sections for enhancing the retentive effect among the second shell means, the first shell means and an insulative housing of the connector which is particularly a mini-sized one.

Another object of the invention is to provide a mini electrical connector having a pair of first retentive sections, a pair of second retentive sections and a third retentive section, so that the connector is easy and convenient to be assembled with the first shell means and the second means for connector manufacturers.

SUMMARY OF THE INVENTION

According to an aspect of the invention, a mini electrical connector for electrically connecting an exterior mating connector and a circuit board, comprises an insulative housing defined with a plurality of walls, a plurality of contacts, a first shell means and a second shell means. The first shell means includes a grounding portion for electrically engaging with an exterior grounding conductor, and a shielding portion for covering at least one of the walls of the housing wherein the shielding portion further has a third retentive section locking a protrusion formed on the housing, and has a pair of orienting sections. Therefore, the first shell means can provide the connector with both of the shielding protection and the grounding protection. The second shell means covering at least one of the other walls of the housing, includes a pair of first retentive sections for cooperation with the orienting section of the first shell means, and a pair of second retentive sections for retentive cooperation with the housing. By means of the first retentive sections, the second retentive sections and the third retentive section, the assembly of the connector with the first shell means and the second shell means is easy and convenient.

DETAILED DESCRIPTION OF THE PREFERRED EMBODIMENTS

References will now be in detail to the preferred embodiment of the invention. While the present invention has been described in with reference to the specific embodiment, the description is illustrative of the invention and is not to be construed as limiting the invention. Various modifications to the present invention can be made to the preferred embodiment by those skilled in the art without departing from the true spirit and scope of the invention as defined by appended claims.

Figure 1:
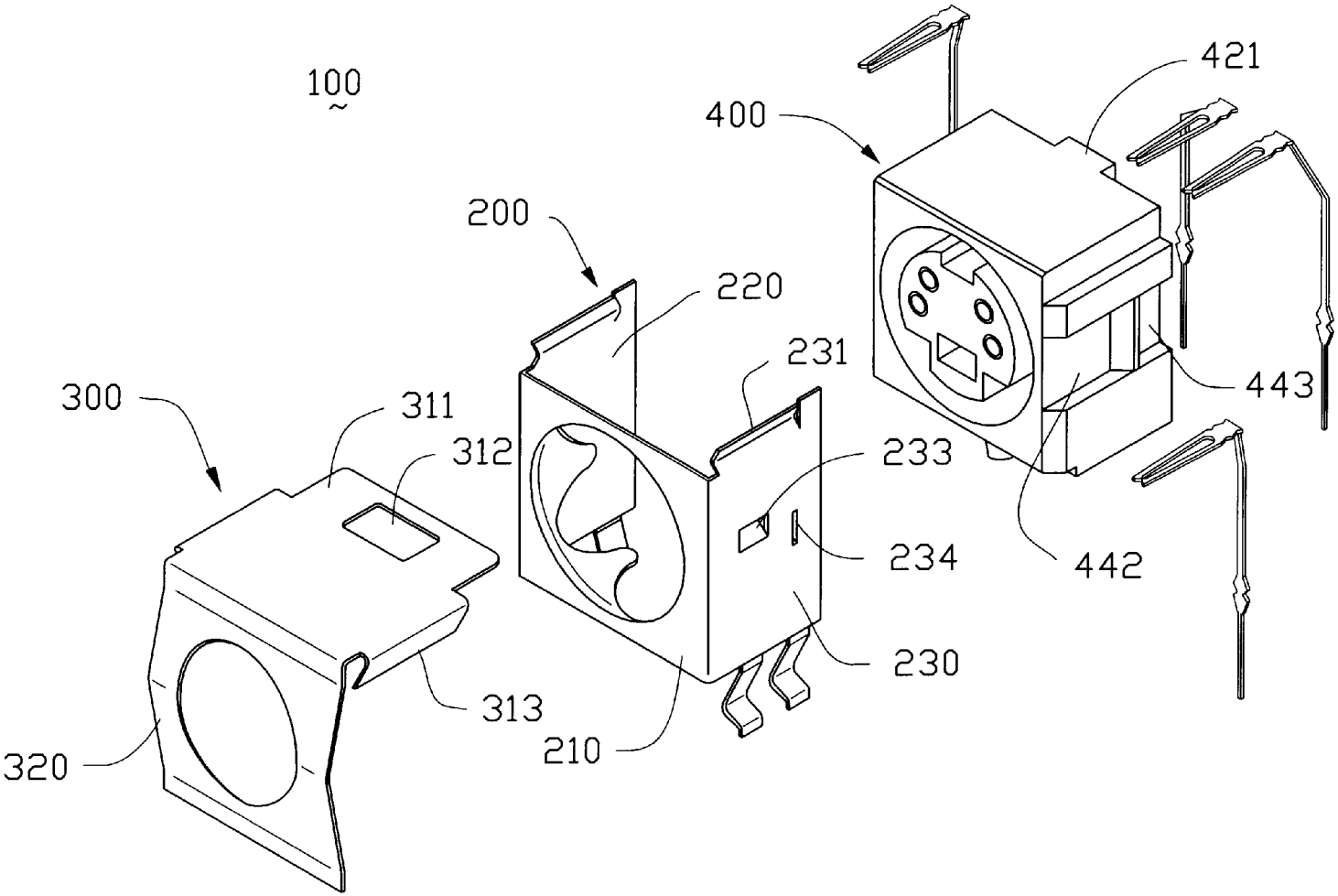
FIG. 1 is an exploded perspective view of a mini electrical connector of the present invention.

It will be noted here that for a better understanding, most of like components are designated by like reference numerals throughout the various figures in the embodiment. The preferred embodiment of the present invention will now be shown with reference to FIGS. 1–5. As shown in FIG. 1, a mini electrical connector (100) for electrically connecting an exterior mating connector (not shown) and a circuit board (not shown), includes a first shell means (300), a second shell means (200), an insulative housing (400) and a plurality of contacts (not labeled).

Figure 2:
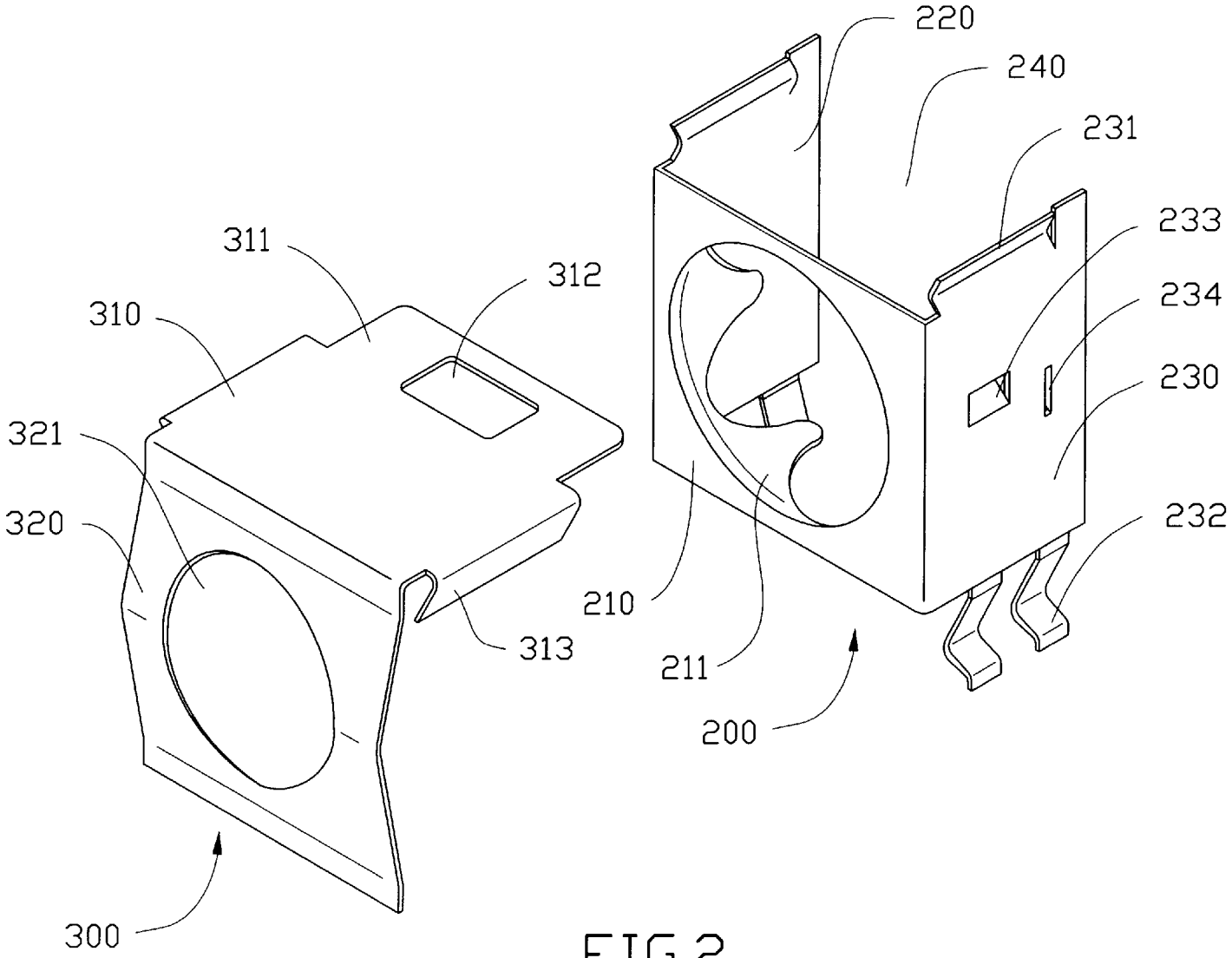
FIG. 2 is a perspective view of a second shell means and a first shell means of the mini electrical connector according to the present invention.

Furthermore, as shown in FIGS. 1 & 2, the second shell means (200) is mainly defined with a front wall (210) and two opposed lateral walls (220, 230) wherein a receiving space (240) is surrounded by said walls (210, 220, 230). A mating opening (211) is formed on a middle area of the front wall (210) and connects said receiving space (240) and an outside of the front wall (210), for receiving an exterior mating connector therein. Along a border of said mating opening (211), some crown-like structures are integrally formed and extend toward said receiving space (240). A pair of first retentive sections (231) each is configured on a top edge of each lateral wall (220, 230) as being an angular bend which is bent toward said receiving space (240). A pair of second retentive sections (not labeled) each is formed on a middle area of a surface of each lateral wall (220, 230) and consists of a horizontal clasp (233) and a vertical clasp (234) which each clasp (233, 234) extends toward said receiving space (240). A plurality of elastic board locks (232) are respectively formed on a bottom edge of each lateral wall (220, 230), for locking a few associated apertures formed on a surface of the circuit board.

The first shell means (300) defined with two walls, includes a grounding portion (320) and a shielding portion (310). The grounding portion (320) forms thereon an outer opening (321) and an outward bend on a middle area thereof wherein the outer opening (321) is used to be aligned with said mating opening (211) of the second shell means (200) for receiving the exterior mating connector, and the outward bend is adapted to electrically engage with an exterior grounding conductor like a panel of the computer enclosure (not shown) for grounding protection. The shielding portion (310) is generally defined with a flat plate, and has therein a front edge angularly and integrally connected with said grounding portion (320), a rear edge connected with a third retentive section (311), and two opposed lateral edges respectively connected with two orienting sections (313). The third retentive section (311) is configured with a connecting plate with a rectangular hole (312). Each orienting section (313) is defined with an angular bend along each lateral edge of the shielding portion (310) wherein a free end of the bend slantingly and inwardly extends for compliance with said first retentive sections (231) of the second shell means (200).

Figure 3:
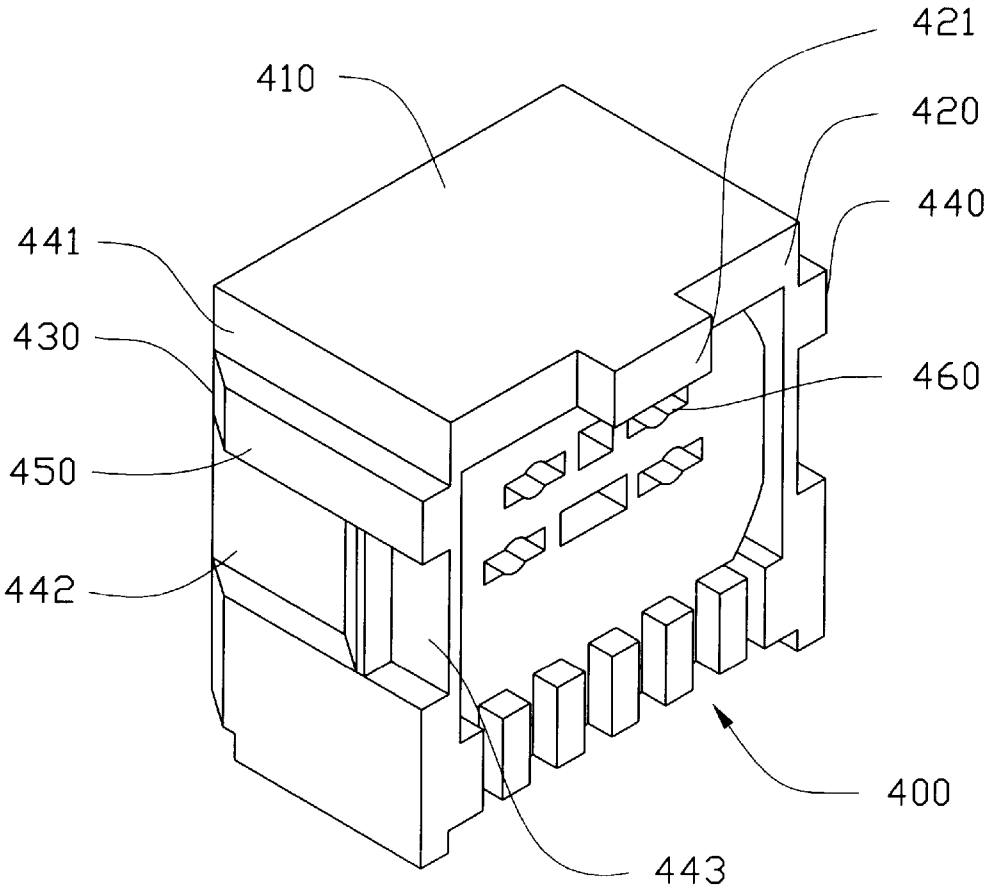
FIG. 3 is a perspective view of an insulative housing of the mini electrical connector according to the present invention.
Figure 4:
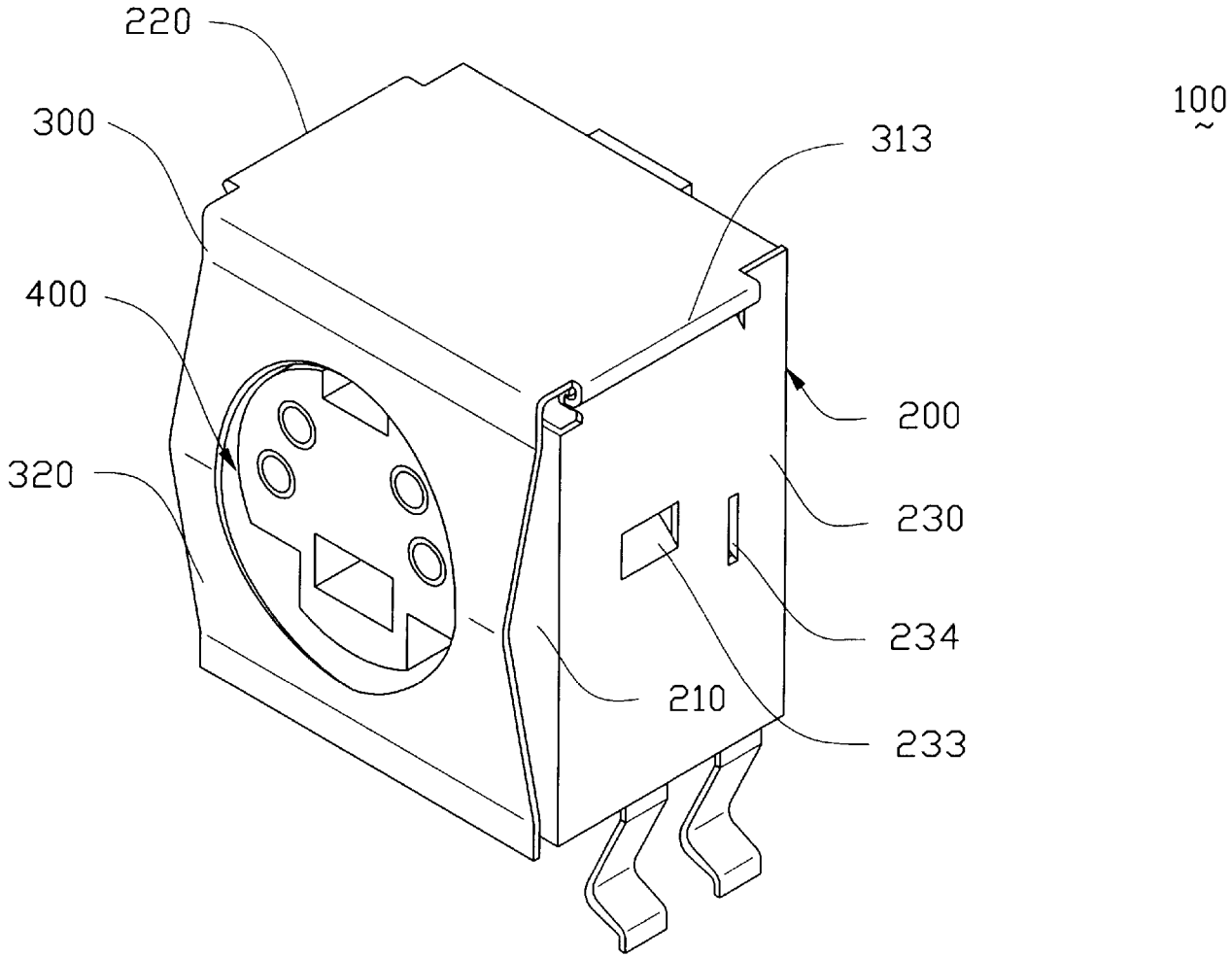
FIG. 4 is a front perspective view of the assembled mini electrical connector in accordance with the present invention.
Figure 5:
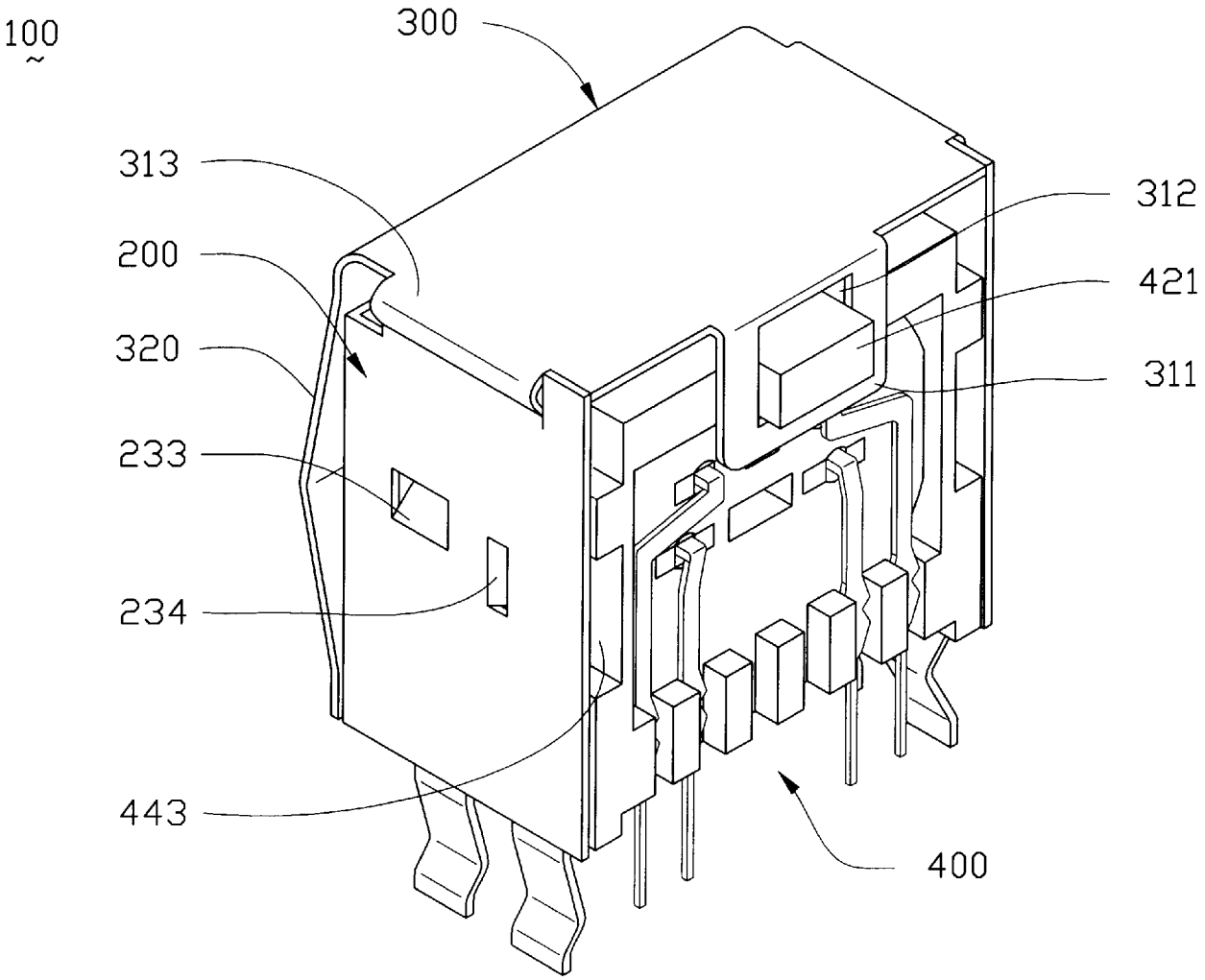
FIG. 5 is a rear perspective view of the mini electrical connector in accordance with FIG. 4.

As shown in FIGS. 1 & 3, the insulative housing (400) includes a plurality of passageways (460) extending through both of a front wall (430) and a rear wall (420) thereof. A first notch (441), a second notch (442) and a third notch (443) are formed on each lateral wall (440, 450) of the housing (400). Said first notch (441) is approximately located on a top edge of each lateral wall (440, 450), and is separated from the second notch (442) and the third notch (443) by a horizontal partition (not labeled). The second notch (442) and the third notch (443) are approximately located on a middle area of each lateral wall (440, 450) and are further separated from each other by a vertical partition (not labeled). A protrusion (421) adjacent to a connecting area between a top wall (410) and the rear wall (420) extends outwardly.

Regarding the assembly of the connector (100), it can refer to FIGS. 1–3. First, when the second shell means (200) is assembled with the insulative housing (400), said insulative housing (400) is received within the receiving space (240) of the second shell means (200) so that the front wall (210) and the opposed lateral walls (220, 230) of the second shell means (200) can cover the front wall (430) and the opposed walls (440, 450) of the housing (400) for shielding protection. The second retentive sections of the insulative housing (400) including the horizontal clasps (233) and the vertical clasps (234) are respectively received within the second notches (442) and the third notches (443) of the second shell means (200) to abut against a corresponding side (not labeled) in each notch (442, 443). It is understood that by means of cooperation between the clasps (233, 234) and the associated notches (442, 443), the second shell means (200) is restricted to move in both vertical and horizontal directions thereof. And, the first retentive sections (231) are also received within the first notches (441) of the insulative housing (400).

Second, when the first shell means (300) is intended to be assembled with the second shell means (200) of the connector (100), the orienting sections (313) of the first shell means (300) are extended into the third notches (441) of the housing (313) to retentively abut against the first retentive sections (231) of the second shell means (200), so that the first shell means (300) can slide horizontally on the top wall (410) of the housing (400) along the bends formed on the first retentive sections (231) of the second shell means (200), which are functioned as two guiding rails.

When each orienting section (313) moves to reach a rear end of the corresponding first retentive section (231), the shielding portion (311) can directly cover the whole top wall (410) of the housing (400), and the grounding portion (320) can be located in front of the front wall (210) of the second shell means (200), for providing the connector with both of the shielding protection and grounding protection. Then, by means of operation of an exterior tool, the third retentive section (311) can be perpendicularly bent to have the rectangular hole (312) therein to tightly lock the protrusion (421) on the rear wall (420) of the housing (400) whereby the first shell means (300) is restricted to move in both vertical and horizontal directions thereof. In addition, the outer opening (321) of the first shell means (300) can be aligned with the mating opening (211) for receiving the insertion of the exterior mating connector therein. The results of assembly of the connector (100) can refer to FIGS. 4 & 5.

Therefore, based on the above mentioned, it is noted that by means of the first retentive sections (231), the second retentive sections and the third retentive section (311), the second shell means (200) and the first shell means (300) are very convenient and easy to be assembled with the insulative housing (400) for connector manufacturers. And, the retentive effect among the second shell means (200), the first shell means (300) and an insulative housing (400) of the connector (100), which is particularly a mini-sized one, can be enhanced by all of the retentive sections.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. A mini electrical connector for electrically connecting an exterior mating connector and a circuit board, comprising:

an insulative housing defined with at least a mating wall and a plurality of lateral walls and receiving a plurality of contacts therein;

a first shell means integrally defined with at least a shielding wall covering one lateral wall of the housing, and a grounding portion extending in front of the mating wall of the insulative housing, along an edge of the shielding wall, to electrically engaging with a panel of an exterior apparatus for grounding protection;

a second shell means defined with at least a front wall covering the mating wall of the housing, having therein a second retention movably retained with the shielding wall of the first shell means, and a third retention retained with at least one of the other lateral walls of the insulative housing for attaching the second shell means to the housing.

2. A mini electrical connector for electrically connecting an exterior mating connector and a circuit board, comprising:

an insulative housing defined with a plurality of walls and receiving a plurality of contacts therein;

a first shell means integrally defined with at least a first wall which laterally forms at least an orienting section;

a second shell means having at least a second wall with a retention section which forms an angular bend apart from the second wall to retentively abut against said orienting section of the first shell means thereby guiding the first shell means to slide on the second shell means along a horizontal direction but to restrict the first shell means from moving along a vertical direction with regard to the second shell means when the first shell means is assembled with the second shell means.

3. The mini electrical connector as described in claim 2, wherein the orienting section of the first shell means is defined with a bend.

4. The mini electrical connector as described in claim 2, wherein the housing has a notch for receiving the retentive section of the second shell means and the orienting section of the first shell means therein.

5. The mini electrical connector as described in claim 2, wherein the retentive section of the first shell means is retentively cooperated with the housing.

6. An electrical connector for electrically connecting an exterior mating connector and a circuit board, comprising:

an insulative housing defining a plurality of walls and receiving a plurality of contacts therein;

a first shell means having a first shield portion for directly covering at least one of said walls of the housing, and a grounding portion integrally extending from said first shield portion for electrical engagement with an exterior grounding conductor; and a second shell means having a second shield portion for directly covering at least one of the other walls of the housing;

wherein the first shield of the first shell means and the second shield portion of the second shell means cover the corresponding walls of the housing exclusively with each other, and wherein said grounding portion of the first shell means defines an outer opening in alignment with a mating opening defined in the second shell means for receiving the exterior mating connector.

7. A mini electrical connector for electrically connecting an exterior mating connector and a circuit board, comprising:

an insulative housing defined with at least an opposite front and rear walls, and a plurality of lateral walls formed between said front and rear walls, receiving a plurality of contacts therein;

a first shell means integrally defined with at least a shielding wall covering one lateral wall of the housing, and a pair of orienting sections oppositely and laterally bent from the shield wall, and a first retention extending adjacent from an edge of the shielding wall to directly lock with a protrusion formed on the rear wall of the insulative housing; and a second shell means retained above the housing, integrally defined with at least a pair of shell walls each of which an edge forms a second retention for retention with said corresponding orienting section of the first shell means whereby the first shell means is restricted from moving along both vertical and horizontal directions with regard to the second shell means.

* * * * *